United States Patent [19]

Keil et al.

[11] Patent Number: 4,488,974

[45] Date of Patent: Dec. 18, 1984

[54] SOFTENER EMULSION, A PROCESS FOR ITS PREPARATION, AND ITS APPLICATION

[75] Inventors: Karl-Heinz Keil, Hanau-Mittelbuchen; Ulrich Greiner, Schöneck; Georg-Wolfgang Eckardt, Frankfurt am Main; Volker Köhler, Niedernhausen, all of Fed. Rep. of Germany

[73] Assignee: Cassella Aktiengesellschaft, Frankfurt am Main, Fed. Rep. of Germany

[21] Appl. No.: 552,723

[22] Filed: Nov. 17, 1983

[30] Foreign Application Priority Data

Nov. 30, 1982 [DE] Fed. Rep. of Germany ..... 3244265

[51] Int. Cl.[3] ..... D06M 13/16; D06M 13/18; D06M 13/40

[52] U.S. Cl. ..... 252/8.8; 252/548

[58] Field of Search ..... 252/8.8, 548

[56] References Cited

U.S. PATENT DOCUMENTS

| | | | |
|---|---|---|---|
| 2,477,346 | 7/1949 | Pikl | 546/336 |
| 3,671,308 | 6/1972 | Diery et al. | 427/393.4 |
| 3,696,034 | 10/1972 | Hewitt et al. | 252/8.8 |
| 3,983,043 | 9/1976 | Brandeis et al. | 252/8.8 |
| 4,272,413 | 6/1981 | Bauman | 252/8.8 |
| 4,307,079 | 12/1981 | Zorayan et al. | 252/548 |

*Primary Examiner*—Maria Parrish Tungol

*Attorney, Agent, or Firm*—Connolly and Hutz

[57] ABSTRACT

A softener emulsion for making textiles water-repellent and improving their handle is prepared by melting a mixture of $R—NH—CO—NH—CH_2—(O—CH_2—CH_2)_n—OR^1$, $R^2—CO—NH—CH_2—(O—CH_2—CH_2)_n—OR^1$, $R—NH—CO—NH—CH_2OH$ and $R^2—CO—NH—CH_2OH$ together with an anionic emulsifier and emulsifying the melt into an emulsion with water and alkaline earth metal ions.

10 Claims, No Drawings

SOFTENER EMULSION, A PROCESS FOR ITS PREPARATION, AND ITS APPLICATION

The invention relates to an aqueous reactive stable-viscosity softener emulsion that has a long shelflife and a water-repelling action, to a process for its preparation, and to its application.

There have been many and varied attempts to improve the handle of dyed as well as undyed textile material and to make the textile material water-repellent. It is desirable for reasons of cost to carry out the finishing process and the dyeing step in one stage and to obtain the improvement in handle and the water-repellency by applying one class of compound. German Pat. No. C 1,231,663 (corresponding to Great Britian Pat. No. 862,197) relates to a process for making textiles water-repellent, in which the textiles are treated with liquors which contain heat-hardenable polysiloxanes, condensing agents for the polysiloxanes, and condensation products of aminoplast-forming N compounds, formaldehyde, aliphatic monocarboxylic acids having more than 10 C atoms and/or resin acids and alkanolamines. Afterwards the textiles are dried and the polysiloxanes condensed. The presence of customary synthetic resin precondensates can have the effect that the textile is not only made water-repellent but also has its handle improved. The simultaneous water-repellency and handle improvement can only be achieved by applying products of different classes of substance, which requirement leads to shelflife problems, and, consequently, the various substances can be added to the finishing bath only shortly before the treatment. The condensation reaction is carried out in the presence of soaps or salts of polyvalent metals, such as, for example, zirconium, at temperatures of 130° to 150° C., which must be complied with very accurately, since otherwise the handle is found to deteriorate drastically.

German Pat. No. A 2,221,166 discloses water-repellents that contain a water-repelling aminoplast, a paraffin with a melting point of 40° to 80° C., and certain thermally cleavable emulsifiers. It is a disadvantage of these water-repellents that synthetic resin precondensates have to be used. Furthermore, the application of cleavable emulsifiers to the textile material makes it very likely that the hardened textile material will suffer a marked deterioration in rubbing fastness.

German Pat. No. B 1,934,177 (corresp. to U.S. Pat. No. 3,671,308) discloses softeners in the form of aqueous solutions or dispersions that contain, as the softener component, reaction products of at least 3 mols of formaldehyde and 1 mol of N-alkylurea or N-alkylbiuret compounds having about 14 to 22 C atoms in the alkyl radical. These softeners produce a handle that is still not smooth and soft enough in some cases, and the degree of water-repellency is inadequate.

German Pat. No. B 2,320,302 (corresp. to U.S. Pat. No. 3,983,043) discloses mixtures of at least one mono- and/or dimethylolalkylurea having 12 to 22 C atoms in the alkyl radical and at least one butyl ether of a mono- and/or dimethylolalkylurea having 12 to 22 C atoms in the alkyl radical, which are used as softeners for cellulose fibres. The degree of water-repellency of these mixtures is inadequate, and the handle obtained on the goods still does not have the desired fullness. The butyl ethers give rise to odour problems in the course of processing, and disposing of the liquors gives rise to waste water problems. Moreover, emulsions of these mixtures have a very short shelflife.

U.S. Pat. No. 2,477,346 discloses N-methylolbehenamide and N-methyloldocosylcarbamate for use as water-repellents. Because of their high melting points, however, these compounds are difficult to convert into aqueous emulsions, and, what is more, these emulsions are not very durable and have a short shelflife. Moreover, these compounds cannot be applied in one bath together with synthetic resin precursors, since otherwise the finishing bath becomes unstable.

There is therefore an urgent need for a water-repelling softener that is free of the disadvantages of existing softeners, that has, in particular, a stable viscosity and a long shelf life, that gives problem-free processing even in baths containing synthetic resin precondensates, and that gives cellulose/synthetic fibre combinations a full wool-like handle together with an excellent degree of water-repellency. The softener emulsion of the invention meets these requirements.

The softener emulsion of the invention contains 15 to 35% by weight of a mixture that contains a mol % of $$R—NH—CO—NH—CH_2—(O—CH_2—CH_2—)_n—OR^1 \quad (I)$$

b mol % of $$R^2—CO—NH—CH_2—(O—Ch_2—CH_2)_n—OR^1 \quad (II)$$

c mol % of $$R—NH—CO—NH—CH_2OH \quad (III)$$

d mol % of $$R^2—CO—NH—CH_2OH \quad (IV)$$

0.5 to 6% by weight of at least one anionic emulsifier,
0.25 to 3% by weight of at least one alkaline earth metal ion in the form of at least one soluble alkaline earth metal compound,
0 to 10% by weight of at least one solvent completely miscible with water, and
46 to 84.25% by weight of water,
where the numbers a, b, c and d are defined as follows:
a is from 10 to 96,
b is from 0.7 to 50,
c is from zero to 77, and
d is from zero to 40,
and the conditions $$a+b+c+d=100,$$

$$(a+c):(b+d)=1:(1 \text{ to } 0.04),$$

$$(a+b):(a+b+c+d)=1:(1 \text{ to } 5)$$

also have to be satisfied, and
R denotes an alkyl radical having 12 to 22 C atoms,
$R^1$ denotes an alkyl radical having 1 to 4 C atoms,
$R_2$ denotes an alkyl radical having 12 to 30 C atoms, and
n denotes a number from 1 to 3.

The radicals R, $R^1$ and $R^2$ can be straight-chain or branched. $R^2$ preferably denotes a straight-chain alkyl radical having 18 to 22 C atoms, $R^1$ preferably denotes methyl or ethyl, and R preferably denotes an alkyl radical having 18 to 22 C atoms. The ratio of (a+b):(a+b+c+d) is preferably 1:(1.43 to 3.3).

A substance used as an anionic emulsifier can be in particular a representative of the following classes V to VII:

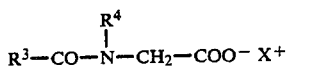

(V)

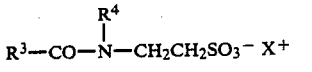

(VI)

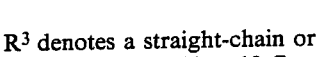

(VII)

wherein $R^3$ denotes a straight-chain or branched alkyl or alkenyl radical having 12 to 18 C atoms, $R^4$ denotes hydrogen or a straight-chain or branched alkyl radical having 1 to 4 C atoms, $X^+$ denotes a monovalent cation or half a divalent cation, and m denotes a number from 10 to 30, preferably from 20 to 30. $X^+$ preferably denotes an alkali metal cation, in particular the sodium or potassium cation, half an alkaline earth metal cation, in particular half a calcium, magnesium or strontium cation, the ammonium cation or a substituted ammonium cation, such as, for example, tris-hydroxyethylammonium.

An $R^3$ alkyl radical of the range from 12 to 18 C atoms is preferably a composition of the type that occurs in natural fatty acids. Examples of preferred $R^3$ alkyl radicals are thus:

coconut alkyl (51% C-12, 19% C-14, 8% C-16, 9% C-18), stearyl (1% C-12, 2% C-14, 12% C-16, 69% C-18), and tallow alkyl (1% C-12, 2% C-14, 30% C-16, 66% C-18).

The softener emulsion can contain a single anionic emulsifier or a mixture of various anionic emulsifiers.

Examples of alkaline earth metal ions which can be used are the magnesium, calcium and strontium ions and mixtures thereof. The alkaline earth metal ions are introduced into the emulsion in the form of soluble alkaline earth metal compounds, for example in the form of the chlorides or nitrates. The alkaline earth metal ions can conveniently also be introduced in the form of the alkaline earth metal salt of the anionic emulsifier, and consequently there might not be any need to add a further alkaline earth metal salt.

Examples of solvents which are completely miscible with water are lower alcohols, such as, for example, ethanol, ethers, such a for example, dioxane, and etherified glycols, such as, for example, methylglycol, ethylglycol, ethyldiglycol, methyldiglycol, n-propylglycol, i-propylglycol, n-butylglycol, n-butyldiglycol or i-butyldiglycol.

The softener emulsion of the invention is prepared by melting a mixture that contains the compounds I to IV together with at least one anionic emulsifier at temperatures of, for example, 70° to 100° C., preferably 75° to 95° C., and converting the melt by means of warm water and a high-speed mixing or homogenising device into an aqueous emulsion, and adding, before, during or after the emulsification, further alkaline earth metal ions in the form of soluble alkaline earth metal compounds, unless the necessary alkaline earth metal ion content has already been established in the form of an anionic emulsifier that contains alkaline earth metal ions, and if desired by adding before, during or after the emulsification at least one solvent that is miscible with water. In preparing the softener emulsion the amounts of the individual components are chosen in such a way that a softener emulsion of the composition mentioned forms. Particularly favourable softener emulsions are obtained when the melt that contains the compounds of the formula I to IV and the anionic emulsifier, or the mixture of various anionic emulsifiers, are held together in the state of a liquid melt at temperatures of 70° to 100° C., preferably 75° to 95° C., for 10 to 60, preferably 10 to 30, minutes before the emulsification. As a result of the condensation that takes place under these conditions the application properties, in particular the shelflife, of softener emulsions of the invention are yet further improved to a considerable degree.

A mixture containing:

a mol % of compound of the formula I, b mol % of compound of the formula II, c mol % of compound of the formula III and d mol % of compound of the formula IV, where the numbers a, b, c and d have the values already mentioned, is preferably prepared as follows:

A urea of the formula VIII

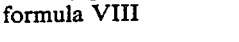

(VIII)

and an amide of the formula IX (IX)

are melted together in a molar ratio of 1:(1 to 0.04), where R and $R^2$ have the abovementioned meanings, into a homogeneous melt, and that requires temperatures of, for example, 120° to 140° C. The melted compounds VIII and IX are then methylolated and, at the same time or afterwards in a separate stage, etherified with a glycol ether of the formula X

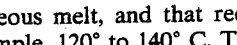

(X)

wherein $R^1$ and n have the abovementioned meanings.

To methylolate the melt of the compounds of the formulae VIII and IX, it is cooled down to temperatures of 90° to 120° C., preferably 90° to 95° C., and is admixed with twice to four times the molar amount of formaldehyde or substances that split off formaldehyde. The formaldehyde is preferably introduced into the melt in the form of a solid, for example in the form of paraformaldehyde or metaldehyde. If the methylolation is carried out at temperatures below 100° C., the formaldehyde can also be introduced into the melt in the form of an aqueous solution, for example in the form of the 39% strength aqueous solution customary in the trade. The etherification with the compound of the formula X is preferably carried out in one stage with the methylolation in the presence of a basic catalyst, such as a tertiary amine or alkanolamine, for example triethanolamine, N-methylcyclohexylamine or N-methylmorpholine, in an amount of, for example, 0.5 to 2% by weight. If the etherification is carried out in this way, the formaldehyde is preferably introduced into the melt in the form of a solution of paraformaldehyde in the glycol ether of the formula X. The glycol ether is used in an amount of about 2 to 3 mol. The methylolation and etherification is complete after about 1 to 4 hours. If desired, any excess glycol ether of the formula X still present can then be distilled off under reduced pressure. However, it is not necessary to remove excess glycol ether of the formula X completely, since, as a solvent completely miscible with water, it may remain in the softener emulsion of the invention.

However, it is also possible to carry out the methylolation first, followed, in a second stage, by the etherification with the glycol ether of the formula X. In this case the etherification is carried out at temperatures of 60° to 150° C., preferably 80° to 120° C., in the presence of catalytic amounts of acids, such as hydrochloric, nitric, sulphuric, formic or p-toluenesulphonic acid.

The said methylolation and etherification of a mixed melt of the compounds VIII and IX gives an end product mixture having a degree of etherification of 20 to 100%, preferably 30 to 70%, or, in other words, mixtures of the compounds of the formulae I to IV in such compositions that (a+b):(a+b+c+d)=1:(1 to 5), preferably=1:(1.43 to 3.3).

End product mixtures having degrees of etherification of 30 to 70% are prepared in particular by dissolving a melt of a compound VIII and a compound IX in a glycol ether of the formula X, preferably methylglycol, at temperatures of 90° to 130° C., preferably 95° to 110° C., bringing the solution to pH 7.5–9.5, preferably 8–8.5, and methylolating at said temperatures by adding solid formaldehyde (paraformaldehyde or metaldehyde), the methylolation being followed immediately by an etherification. The pH is established by using, for example, the abovementioned tertiary amines or alkanolamines.

The required starting compounds of the formula VIII can be prepared by reacting an alkyl isocyanate of the formula RNCO with ammonia or, preferably, by reacting an alkylamine of the formula $RNH_2$ with urea. The reaction of the alkyl isocyanate of the formula RNCO with ammonia is generally carried out at temperatures between 15° and 110° C., in particular at 20° to 70° C., in an inert organic solvent, such as a hydrocarbon, ether or halogenated hydrocarbon, such as benzene, toluene, xylene, dioxane, tetrahydrofuran, cyclohexane, chloroform, carbon tetrachloride and/or ethylene chloride. The reaction can also be carried out in a mixture of inert solvents.

It is preferable to prepare the compounds of the formula VIII by melting an amine of the formula $RNH_2$ together with urea, since this gives the compounds of the formula VIII in a form free of biuret-containing by-products and free of the starting amine $RNH_2$. This fact is important for the reasons that the presence of biuret-containing by-products in the final softener emulsion has an adverse effect on the handle, and that residues of starting amine cause yellowing.

The reaction of the alkylamine $RNH_2$ with urea is normally carried out by reacting a relatively long-chain $RNH_2$ alkylamine, such as hexadecylamine, octadecylamine, docosylamine, eicosylamine or, in particular, a technical fatty alkylamine having a natural chain length distribution, such as stearylamine, tallow-amine or behenylamine, at a temperature of 120° to 135° C., preferably 130° C., and under a protective gas such as nitrogen, by the continuous, metered addition of urea accompanied by the evolution of ammonia. It is similarly possible to raise a mixture of the two starting materials, $RNH_2$ and urea, rapidly, within a defined time of 10 to 20 minutes, to a temperature of 120° to 135° C. By sticking closely to the specified reaction conditions it is possible to obtain products which contain less than 1% of residual fatty alkylamine, $RNH_2$, and less than 0.5% of biuret.

A free fatty alkylamine content of greater than 1% would cause the finished textile material to yellow, and a biuret content of greater than 0.5% would markedly worsen the handle of the textile material.

The softener emulsions of the invention display excellent stability, without the appearance of thixotropic effects, over a period of 6 months at room temperature and over 3 months at a temperature of 50° C. Moreover, cotton and viscose textile materials treated with these emulsions are given an extremely full handle, which manifests itself, especially on mixtures of synthetic and cellulose fibres, in a wool-like feel. They are compatible in the bath with other aftertreatment agents and fluorescent brighteners. The softener emulsions of the invention have a surprising effect in that, combined with known glyoxal/urea resin systems, they markedly raise the crease recovery angles (wet and dry) of textile materials finished with the emulsions, an effect that is of considerable importance for the wearability of the finished textiles.

The softener emulsions of the invention are applied in a conventional manner, i.e. the textiles to be finished are treated at temperatures of 80° to 130° C., preferably 100° to 120° C., with liquors that contain per liter 5 to 30 g, preferably 10 to 25 g, of a softener emulsion of the invention. The treatment with the liquor can be carried out in any desired manner, for example by spraying, slop-padding, dipping, cross-padding or the like. The treatment is generally carried out in such a way, if need be by means of subsequent squeezing, that the liquor pick-up is 80 to 60% by weight. The textile material is then dried, preferably at 100° to 125° C. As already mentioned, the softener emulsion of the invention can also be applied together with other finishes, fluorescent brighteners and the like.

EXAMPLE 1

180 g (0.577 mol) of N-octadecylurea are melted at 120° to 130° C. together with 20 g (0.059 mol) of behenamide to give a clear homogeneous melt, which is admixed with 1.5 g of triethanolamine. At the same temperature, a solution of 66.4 g (2.2 mol) of paraformaldehyde in 152.6 g (1.272 mol) of methylglycol is added dropwise in the course of 75 minutes. The resulting mixture is stirred at 115° to 120° C. for 3 hours, and excess methylglycol is then distilled off under reduced pressure to leave behind 243 g of a product mixture that has a melting point of 48° to 49° C. and an analytically determined degree of etherification of 30%.

60 g of the product prepared above are melted at a temperature of 80° to 90° C. together with 15 g of the ammonium salt of the sulphuric acid half-ester of the reaction product of oleyl alcohol and 23 mol of ethylene oxide to give a homogeneous melt in which the condensation reaction is allowed to proceed at 80° to 90° C. for 30 minutes. The mixture is then brought to pH 6–7 by means of triethanolamine and then turned at a temperature of 60° to 70° C. into a highly mobile emulsion by means of a type T 45 Ultra-Turrax homogeniser from Janke and Kunkel KG, D-7813 Staufen im Breisgau, and the addition of 225 ml of water and 0.75 g of calcium chloride ($CaCl_2.6H_2O$). The emulsion thus prepared can be stored at 50° C. for at least 6 weeks without a change in viscosity.

The emulsifier used in the above example can be replaced to equally good effect by using the following compounds as emulsifiers: the sodium, potassium, ammonium, tris-(hydroxyethylammonium), calcium, magnesium or strontium salts of the reaction products of stearic acid with N-methylaminoacetic acid, oleic acid with N-methylaminoacetic acid, sperm oil fatty acid with N-methylaminoacetic acid, stearic acid with β-hydroxyethanesulphonic acid, oleic acid with β-hydroxyethanesulphonic acid, palmitic acid with β-hydroxyethanesulphonic acid, stearic acid with β-methylaminopropionic acid and stearic acid with β-methylaminoethanesulphonic acid.

EXAMPLE 2

A cotton/polyester blend fabric made of 65 parts of cotton and 35 parts of polyester and having a weight of 100 g/m$^2$ is impregnated with a finishing liquor that contains per liter 25 g of the softener emulsion prepared in Example 1. The impregnated fabric is squeezed to a liquor pick-up of 60% and is dried at 100° C. for 8 minutes. This gives a fabric having a finished wool-like, full and voluminous handle.

The fabric's water-repellency is tested by the Pfersee test (in which a standardised area of the finished fabric is sprayed with water and afterwards assessed for the proportion that has not been wetted by the water) to give a value of 70, denoting that 70% of the area exposed to the water has not been wetted.

EXAMPLE 3

A viscose fabric with various finishes is measured for the dry crease recovery angle (in accordance with DIN 53,830) 30 seconds after release from the creasing strain and the wet crease recovery angle 3 minutes after release from the creasing strain.

Finish on the viscose fabric:

(a) None (b) The viscose fabric is padded at 60% pick-up with a liquor that contains per liter 120 g of a glyoxal/urea resin finish (45% strength aqueous solution of a condensation product of 1 mol of glyoxal, 2 mol of urea and 4 mol of formaldehyde) and 15 g of $MgCl_2$. The fabric is then set at a temperature of 155° C. in the course of 180 seconds.

(c) Finish as under (b) above, except that the liquor also contains per liter, 25 g of the softener emulsion prepared in Example 1.

The crease recovery angles are found to be as follows:

| Crease recovery angle | Finish a | Finish b | Finish c |
|---|---|---|---|
| dry | 176° | 262° | 301° |
| wet | 179° | 230° | 260° |

EXAMPLE 4

136 g (0.5 mol) of N-octadecylurea are melted at a temperature of 120° to 130° C. together with 17.3 g (0.051 mol) of behenamide to give a clear homogeneous melt, to which 1.1 g of triethanolamine are added.

A solution of 31.3 g of paraformaldehyde in 129.15 g (1.09 mol) of n-butylglycol is added dropwise to this melt. It is then stirred at 130° to 140° C. for 4 hours, and excess n-butylglycol is then distilled off under reduced pressure to leave behind 178 g of a product mixture that has a melting point of 56° to 58° C. and an analytically determined degree of etherification of 36.8%. 120 g of the melt thus prepared are melted at 80° to 90° C. together with 30 g of the sodium salt of the reaction product of oleic acid and N-methylaminoethanesulphonic acid to give a homogeneous melt, which is brought to pH 6.7 by means of triethanolamine. The melt is then converted into an aqueous highly mobile emulsion by means of a homogeniser and distilled water to which 1% of $CaCl_2.6H_2O$ has been added.

The emulsion has a shelflife at 50° C. of 18 days.

Analogously it is possible to prepare products by using ethylglycol or n-propylglycol in place of n-butylglycol.

EXAMPLE 5

A 500 ml flask that is equipped with a stirrer, a thermometer and a reflux condenser is charged with 96.86 g of stearylamine, which is then melted at a temperature of 130° C. while nitrogen is being passed over, and 27 g of urea are then gradually added. At 130° to 135° C. a reaction sets in accompanied by the evolution of ammonia. The mixture is heated at 140° C. for a further 2 hours after the onset of the reaction.

Found:

free stearylamine content 0.4%, biuret content 0.3%.

The mixture is cooled down to 130° C. to constitute a clear crude melt to which 12.38 g of behenamide are added at 130° C. 55.88 g of methylglycol are then added, followed by 18.7 g of paraformaldehyde at pH 8–8.5 and at a temperature of 110° to 115° C. Excess methylglycol is distilled off in the course of 2 to 3 hours to leave behind the crude product.

Found:

free HCHO content: <0.1%, $CH_3OCH_2CH_2O$ content: 6.0%, corresponding degree of etherification: 32%.

138.4 g of this crude product are melted at 90° C. and pH 8.0 together with 34.6 g of the triethanolamine salt of the sulphuric acid half-ester of the reaction product of oleyl alcohol and 23 mol of ethylene oxide, and the melt is maintained at 90° to 100° C. for 20 minutes, is admixed with 517 ml of distilled $H_2O$ and 1.7 g of $CaCl_2.6H_2O$, and is homogenised to give a stable-viscosity emulsion in accordance with the invention.

What is claimed is:

1. A softener emulsion containing:

46 to 84.25% by weight of water;

15 to 35% by weight of a mixture of nitrogen-containing compounds comprising:

a mol % of $R—NH—CO—NH—CH_2—(O—CH_2—CH_2)_n—OR^1$, b mol % of $R^2—CO—NH—CH_2—(O—CH_2—CH_2)_n—OR^1$, c mol % of $R—NH—CO—NH—CH_2OH$, d mol % of $R^2—CO—NH—CH_2OH$;

0.5 to 6% by weight of at least one anionic emulsifier;

0.25 to 3% by weight of at least one alkaline earth metal ion in the form of at least one soluble alkaline earth metal compound; and 0 to 10% by weight of at least one solvent completely miscible with water;

wherein a is from 10 to 96, b is from 0.7 to 50, c is from zero to 77, and d is from zero to 40, with the proviso that a+b+c+d is 100, (a+c):(b+d) is 1:(1 to 0.04), and (a+b):(a+b+c+d) is 1:(1 to 5), and wherein
R is alkyl having 12 to 22 carbon atoms,
$R^1$ is alkyl having 1 to 4 carbon atoms,
$R^2$ is alkyl having 12 to 30 carbon atoms, and
n is a number from 1 to 3.

2. A softener emulsion according to claim 1 wherein $R^2$ is an unbranched alkyl having 18 to 22 carbon atoms.

3. A softener emulsion according to claim 1 wherein $R^1$ is methyl or ethyl.

4. A softener emulsion according to claim 1 wherein R is an alkyl having 18 to 22 carbon atoms.

5. A softener emulsion according to claim 1 wherein the ration of (a+b):(a+b+c+d) is 1:(1.43 to 3.3).

6. A process for preparing a softener emulsion comprising:

obtaining 15 to 33 parts by weight of a mixture containing:

a mol % $R—NH—CO—NH—CH_2—(O—CH_2—CH_2-)_n—OR^1$, b mol % of $R^2—CO—NH—CH_2—(O—CH_2—CH_2-)_n—OR^1$, c mol % of $R—NH—CO—NH—CH_2OH$, and d mol % of $R^2—CO—NH—CH_2OH$;

melting aforesaid, mixture together with 0.5 to 6 parts by weight of at least one anionic emulsifier;

emulsifying the melt at temperatures from 70° to 100° C. with the addition of water and 0.25 to 3 parts by weight of alkaline earth metal ions in the form of at least one soluble alkaline earth metal compound to produce an emulsion:

wherein
a is from 10 to 96,
b is from 0.7 to 50,
c is from zero to 77,
d is from zero to 40,
with the proviso that
a+b+c+d is 100,
(a+c):(b+d) is 1:(1 to 0.04), and
(a+b):(a+b+c+d) is 1:(1 to 5), and wherein
R is an alkyl having 12 to 22 carbon atoms,
$R^1$ is an alkyl having 1 to 4 carbon atoms,
$R^2$ is an alkyl radical having 12 to 30 carbon atoms, and
n is a number from 1 to 3.

7. The process according to claim 6 wherein up to 10 parts by weight of a solvent completely miscible with water is added during the emulsification step.

8. The process according to claim 6 wherein said amide mixture is prepared by melting a urea of the formula $$R—NH—CO—NH_2$$

and an amide of the formula $$R^2—CO—NH_2$$

in a molar ratio of 1:(1 to 0.04) and methylolating the melt at temperatures of 90° to 120° C. with formaldehyde or substances that split off formaldehyde and, simultaneously or subsequently etherifying with a glycol ether of the formula $$H—(O—CH_2—CH_2)_n—OR^1.$$

9. The process according to claim 6 wherein the melt is maintained at temperatures 70° to 100° C. for 10 to 60 minutes before emulsification with water.

10. A process for imparting to textile materials water-repellency improving the handle, comprising treating textile material at 80° to 130° C. with a liquor containing 5 to 30 grams per liter of a softener emulsion according to claim 1 and then drying the treated textile material.

* * * * *